United States Patent [19]

Anderson

[11] 3,958,436

[45] May 25, 1976

[54] DYNAMICALLY CONTROLLED FORMING BY DRAWING MACHINE

[76] Inventor: Frohman Anderson, 2386 Pleasant St., Dighton, Mass. 02135

[22] Filed: June 30, 1972

[21] Appl. No.: 268,195

[52] U.S. Cl. ..... 72/17; 72/164; 72/307; 72/176

[51] Int. Cl.[2] ..... B21D 5/06

[58] Field of Search ..... 72/378, 379, 377, 301, 72/302, 293, 307, 311, 183, 176, 7, 10, 9, 18, 22, 164, 17

[56] References Cited

UNITED STATES PATENTS

| | | | |
|---|---|---|---|
| 1,828,489 | 10/1931 | Carns | 72/183 |
| 2,092,188 | 9/1937 | Simons | 72/378 |
| 2,288,119 | 6/1942 | Weightman | 72/183 |
| 2,301,960 | 11/1942 | Lermont et al. | 72/183 |
| 2,395,651 | 2/1946 | Anderson | 72/161 |
| 2,449,507 | 9/1948 | Pope | 72/302 |
| 2,480,826 | 9/1949 | Anderson | 72/161 |
| 2,851,080 | 9/1958 | Anderson | 72/183 |
| 3,307,387 | 3/1967 | Lacey, Jr. et al. | 72/379 |
| 3,756,050 | 9/1973 | Kubo | 72/9 |

*Primary Examiner*—Lowell A. Larson

[57] ABSTRACT

Dynamic controls and jaw mechanism for a forming machine adapted to impart compound curvatures to a metal sheet. The setting of the machine, particularly in its first and third stages, is dynamically controlled by a tracer and transducer system whereby, as for example, the vertical and horizontal positions of the first stage relative to the second are predetermined as is the relative horizontal position of the third stage. Enhanced responsiveness is achieved by the provision of roller bearings for the heavy mechanism comprising the several stages. A new jaw mechanism is provided for pulling the sheet through the machine, the jaws being self adjusting to afford a continuous gripping pressure on the sheet.

6 Claims, 10 Drawing Figures

DYNAMICALLY CONTROLLED FORMING BY DRAWING MACHINE

This invention relates to a machine for shaping metal sheets into compound curves by pulling the sheets edgewise from one end to the other over a series of forming elements the working faces of which differ in contour transversely of the sheets and are disposed in stepped relation, a restraining or holdback force being exerted on the sheets in opposition to the pulling force to subject the sheets to stresses beyond their yield point. This operation is termed forming-by-drawing.

Such machines are composed of three main functional components comprising the sheet forming structure, a draw bench including a power-actuated carriage for the mechanism that is to be translated in the performance of the operation, and the sheet pulling mechanism attached to and propelled by the carriage for gripping and drawing the sheets through the forming structure.

The sheet forming structure is composed of three stages through which the sheet progressively passes. The first stage has upper and lower portions which are relatively movable to and from each other and having opposing work elements which provide a slot through which the sheet is drawn and which determines the general path of movement of the work sheet.

The second stage has a draw-over forming element mounted on a vertically movable ram and in operative position having its work engaging face, which is of different contour from the slot, disposed in stepped relation to the slot.

The third stage also has a draw-over forming element of the same contour as that of the second stage element and disposed in stepped relation thereto so as to engage the side of the work sheet opposite that engaged by the second stage element.

The invention contemplates a sheet metal forming machine having improved dynamic control mechanism for predetermining such forming and providing enhanced responsiveness to the control mechanism due to the use of bearing system not hitherto known in the art.

One object of this invention is to provide an improved forming by drawing machine capable of imparting compound curvature to a metal sheet in a manner that is dynamically predetermined.

Another object of the invention is to provide improved jaw mechanism for a forming by drawing machine.

Other objects and advantages of the invention may be appreciated on reading the following description of one embodiment thereof which is taken in conjunction with the accompanying drawings, in which.

Figure 1A:
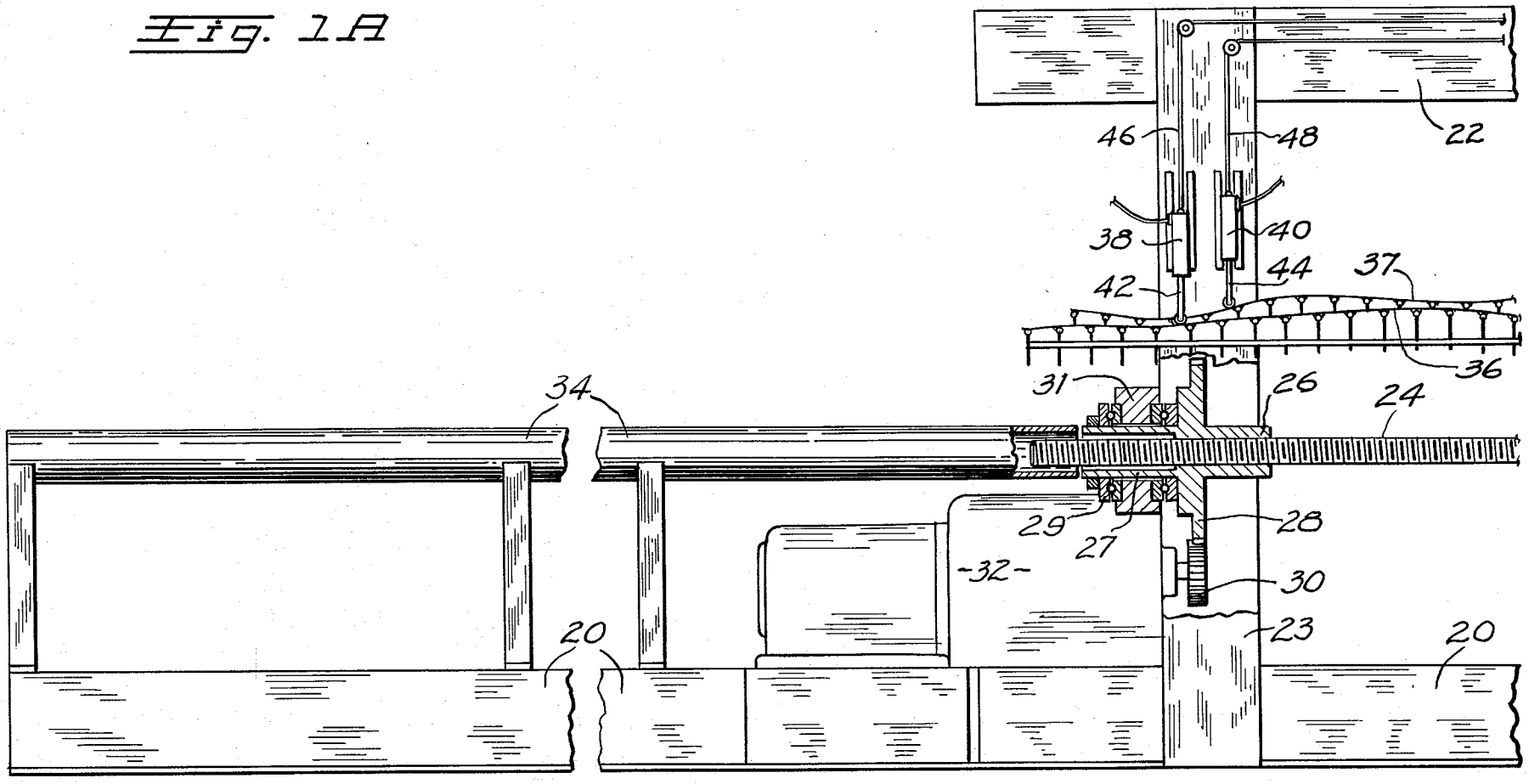
FIG. 1A and FIG. 1B are combined side elevational views with parts broken away showing the improved forming by drawing machine.
Figure 1B:
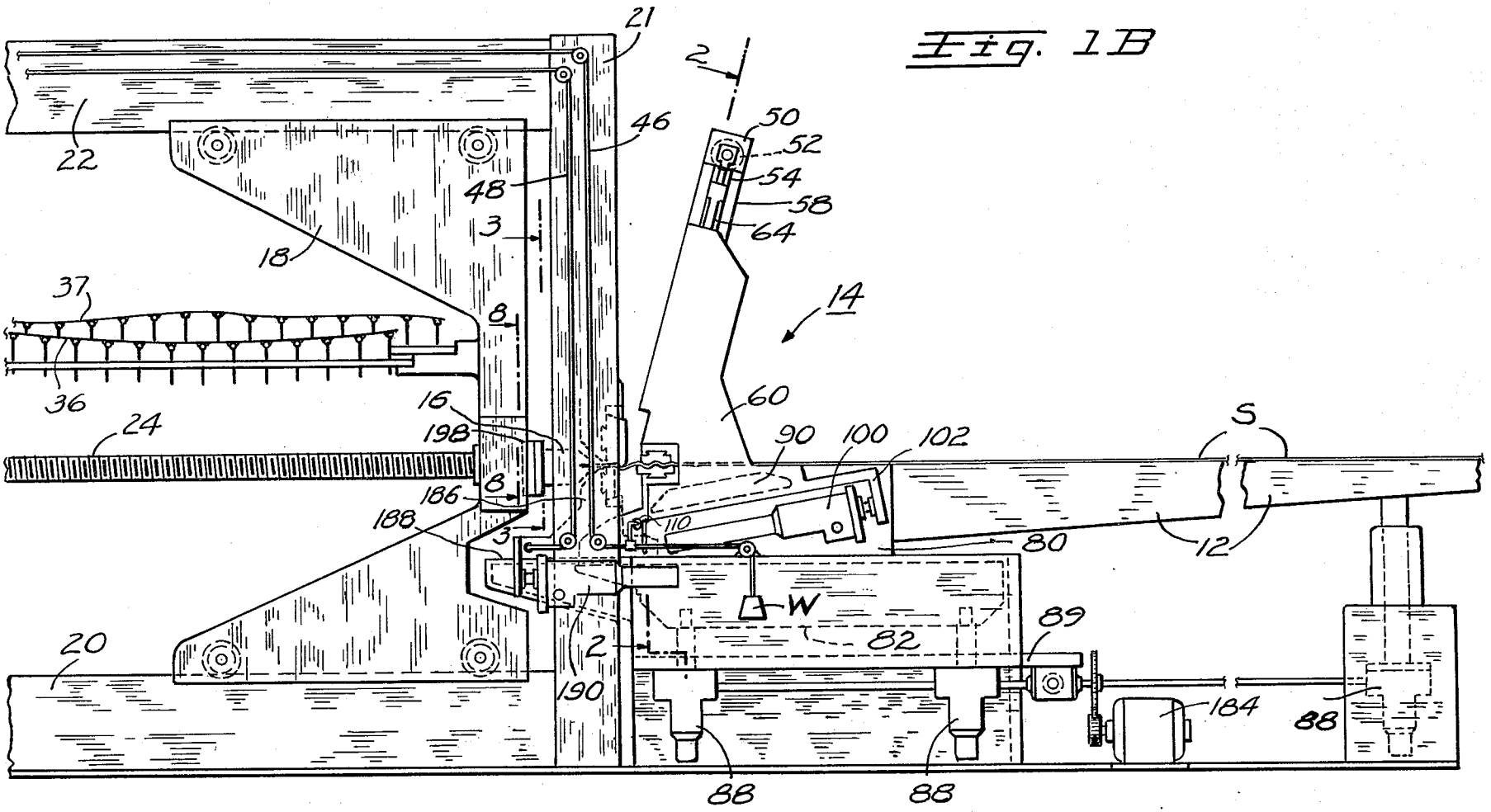

As seen in FIG. 1B there is provided a support table 12 supporting a metal sheet S which is drawn through the forming area 14 of the machine by jaw mechanism 16. The mechanism is attached to carriage 18 which is slidably supported by lower and upper rails 20 and 22, respectively. The rails 20 and 22 are supported in spaced relation by vertical standards 21 and 23. The carriage is moved by attached screw 24 having mounted thereon nut 26 (see FIG. 1A). Nut 26 is integrally combined with gear 28 which is driven by pinion 30 and by means of motor and reduction gearing 32. The nut 26 with its gear 28 has a sleeve extension 27 extending in thrust bearings 29 being held by stationary cross beam 31. The cross beam 31 is carried by the vertical standard 23. The screw 24 extends through the bore of tubular sleeve 34 which is also supported by rail 20.

Referring again to FIG. 1B it is seen that carriage 18 carries a first and second cam element 36 and 37. As seen in FIG. 1A transducers 38 and 40 having tracer fingers 42 and 44, respectively, engage the cams 36 and 37, respectively. The transducers 38 and 40 have attached thereto cables 46 and 48. Cable 46 serves to control the horizontal position of the first stage of the machine relative to the second stage and cable 48 controls the horizontal position of the third stage of the machine relative to the second stage as will be explained below.

Figure 2:
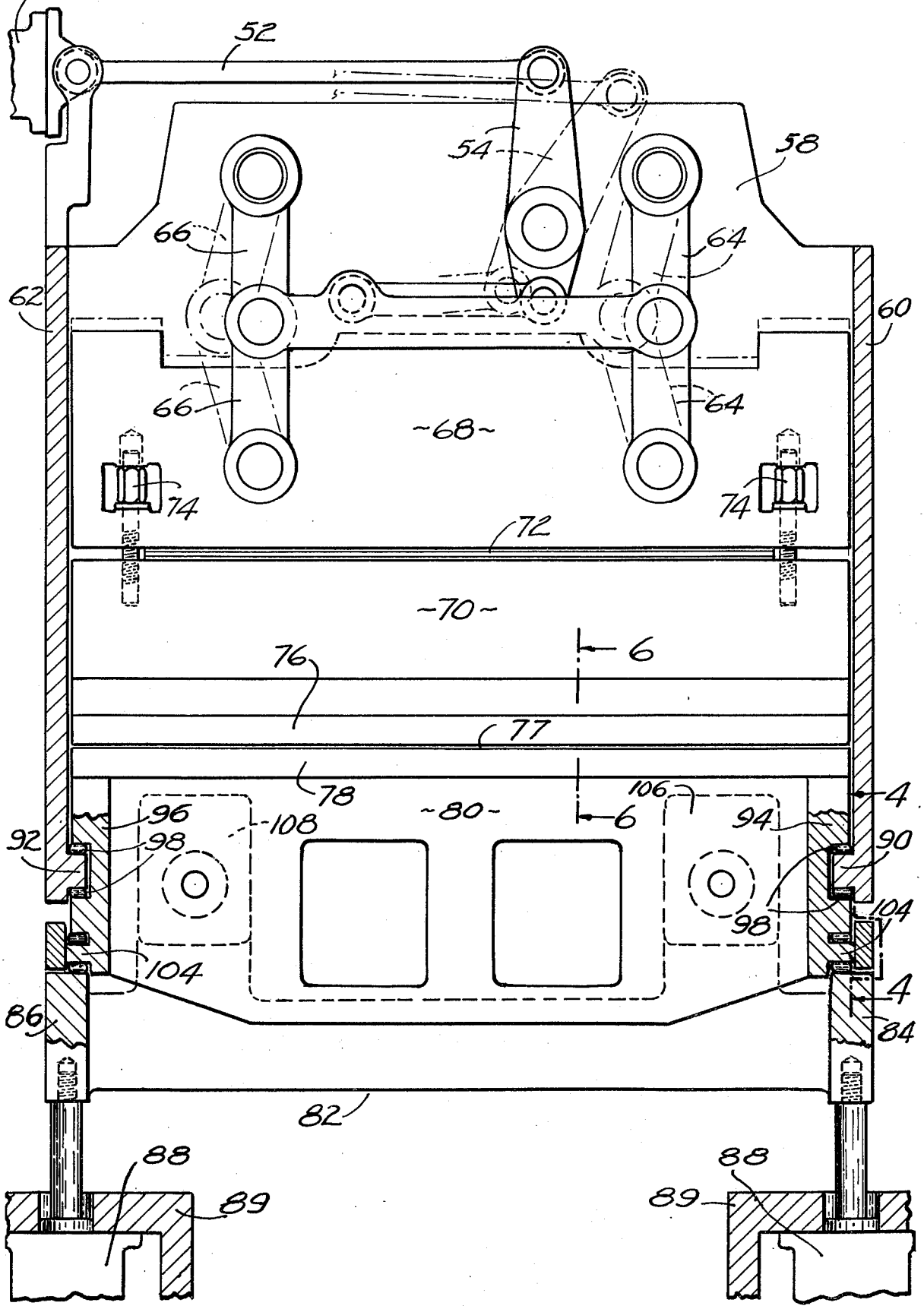
FIG. 2 is a cross sectional view with parts broken away of the upper and lower portions of the first stage including the dynamically controlled toggle arrangement and taken on the line 2—2 of FIG. 1B.

A toggle mechanism is employed to raise and lower the upper elements of the first stage relative to the lower elements of the first stage. As seen in FIG. 2 a linear actuator 50 driven by an SCR time control and motor unit (not shown) positions connecting rod 52 attached to one end of pivot link 54 the other end of which is connected to cross arm 56. The linear actuator preferred for this purpose is the worm gear driven ball screw jack manufactured by the Philadelphia Gear Corporation. The pivot link 54 is pivotally mounted on plate 58 having end plates 60 and 62. The end portions of link 54 are operatively connected to toggle link 64 and 66. The toggle link 64 and 66 are fixedly stationed on the plate 58 and the bottom links 64 and 66 carry the top portion of holdback plate 68 the bottom portion 70 of which is vertically adjusted thereto by shims 72 and locking screws 74. The plate 70 carries on its bottom edge holdback element 76 supported over the lower restraint elements 78 which are supported on the base portion 80 of the first stage. The gap 77 between the upper and lower holdback elements is adjusted by the shim 72 and screw 74 and opened and closed by the toggle mechanism described above. The elements are closed gradually onto the sheet at the start of the machine operation due to the time delay in the SCR circuitry.

Figure 4:
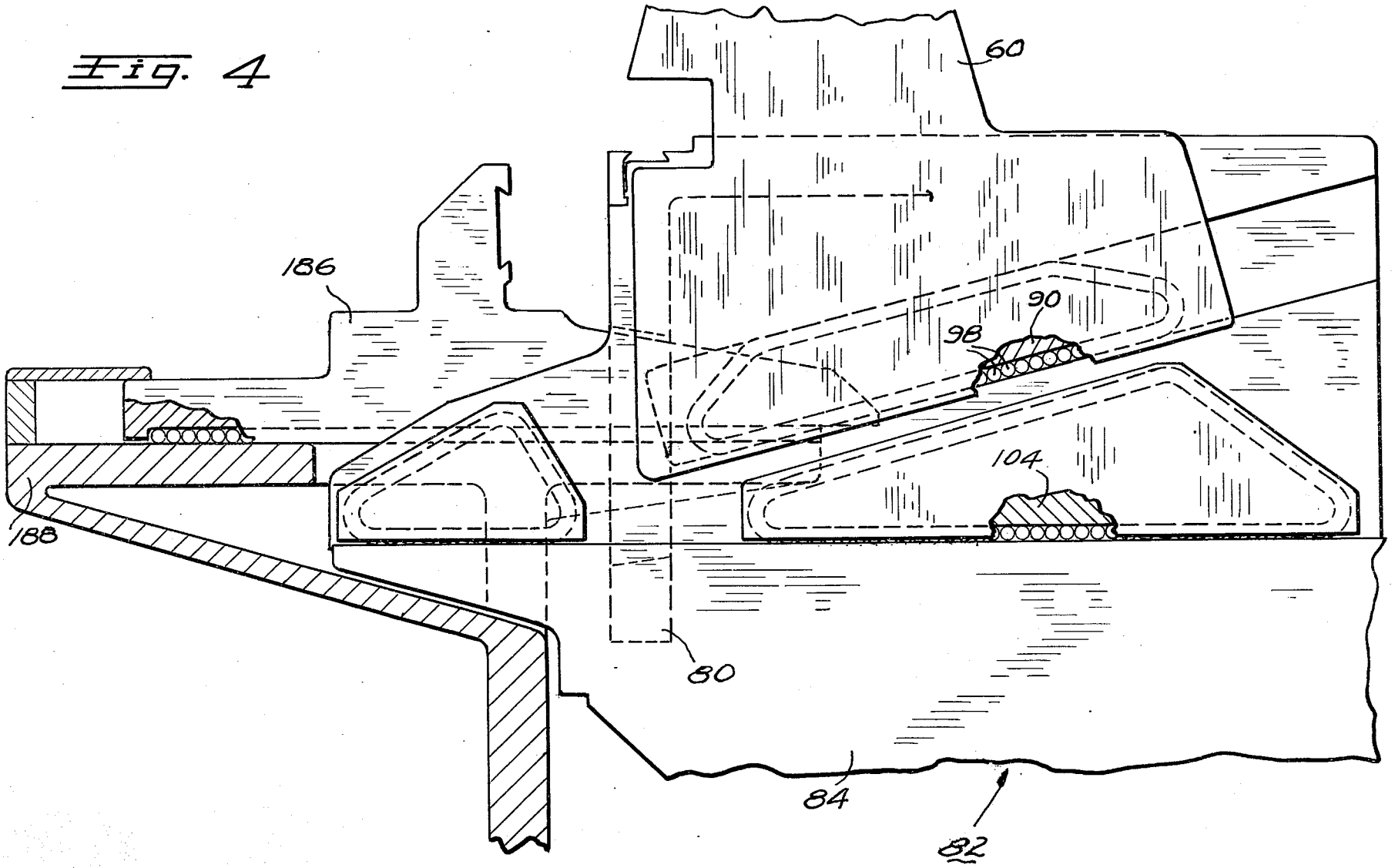
FIG. 4 is an elevational view of the lower portion of the first stage and the third stage showing the roller bearing arrangements and taken on the line 4—4 of FIG. 2.
Figure 5:
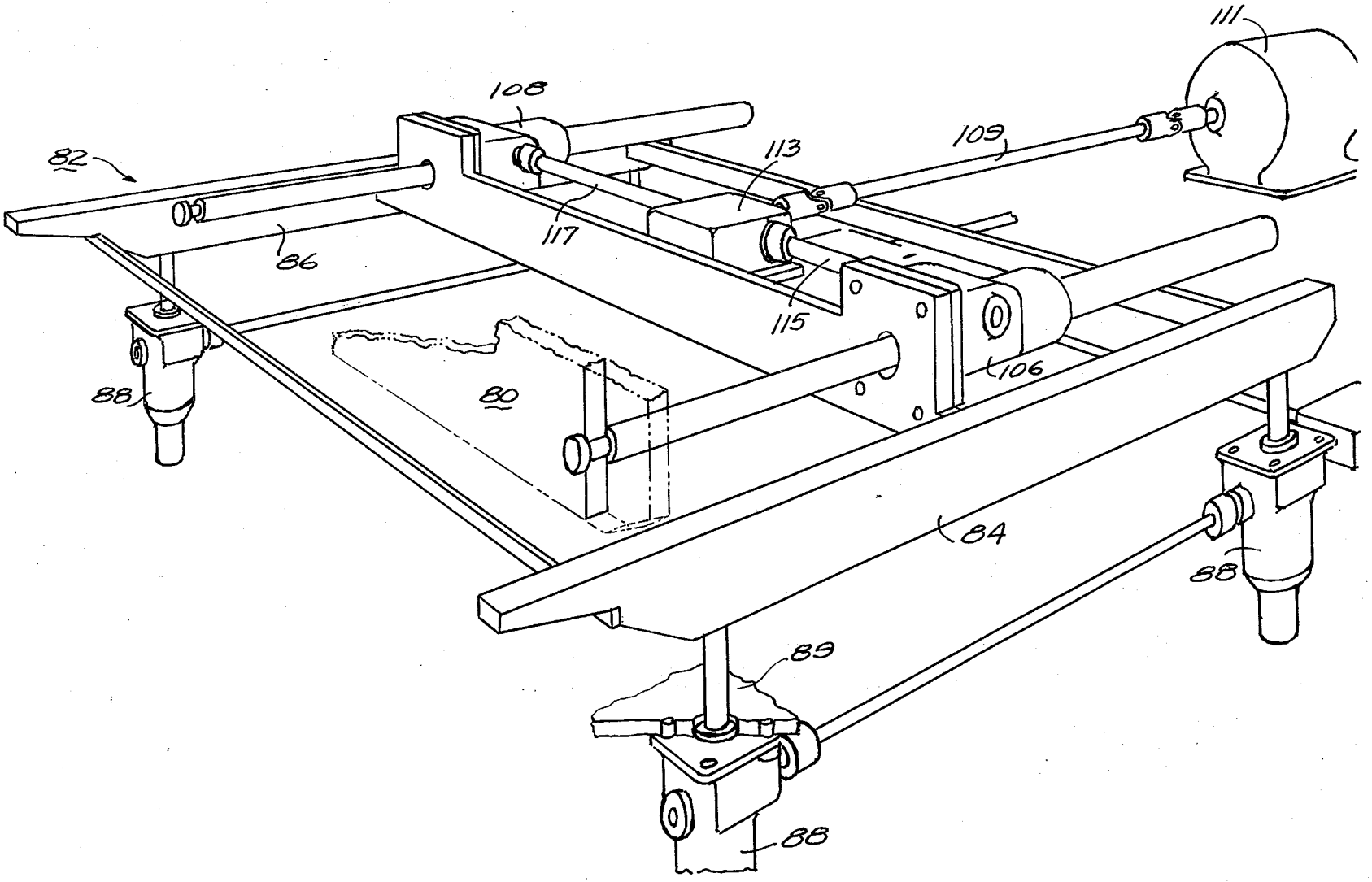
FIG. 5 is a perspective view of the cradle and associated driving means.

The entire first stage of the machine is carried on cradle or carriage 82 having side plates 84 and 86 on which the base portion 80 is mounted. The cradle supporting the first stage of the machine is vertically positioned by means of linear actuators 88 mounted on the base plate 89 one being disposed at each of the four corners of the cradle frame as seen in FIG. 5. The end plates 60 and 62 having inwardly extending race portions 90 and 92 that form one side of a roller bearing track the other side of which are end walls 94 and 96 of the base portion 80 which form with the race portions an endless track for roller bearings 98 as shown in FIG. 4. This track permits the upper portion of the first stage to be moved upwardly and rearwardly relative to the base portion 80. This is achieved by linear actuators 100 which engage extensions 102 on the end plates 60 and 62 as seen in FIG. 1B. Normally the gap 77 is opened and closed by the toggle mechanism as above described, but in certain instances, particularly where the metal sheet S may be wrinkled or wavey it may be necessary to open the machine further by the actuators 100 in order to apply the proper restraint on the sheet during the operation.

The end walls 94 and 96 of the base portion 80 have outward extensions 104 which together with the side plates 84 and 86 of the cradle 82 form an endless roller bearing track on which the entire structure of the first stage is horizontally displaced through the action of linear actuators 106 and 108. The actuators 106 and 108 are driven by universal shaft 109 and motor 111 through miter gear box 113 and shafts 115 and 117, respectively.

As the first stage is moved a follower 110 on the cable 46 engaging the rear edge of base portion 80 is kept in such engagement by the weight W. The follower senses the movement and moves the transducer 38 by cable 46 to a null position in order to stop the first stage at a predetermined position as established by the cam surface 36.

Figure 3:
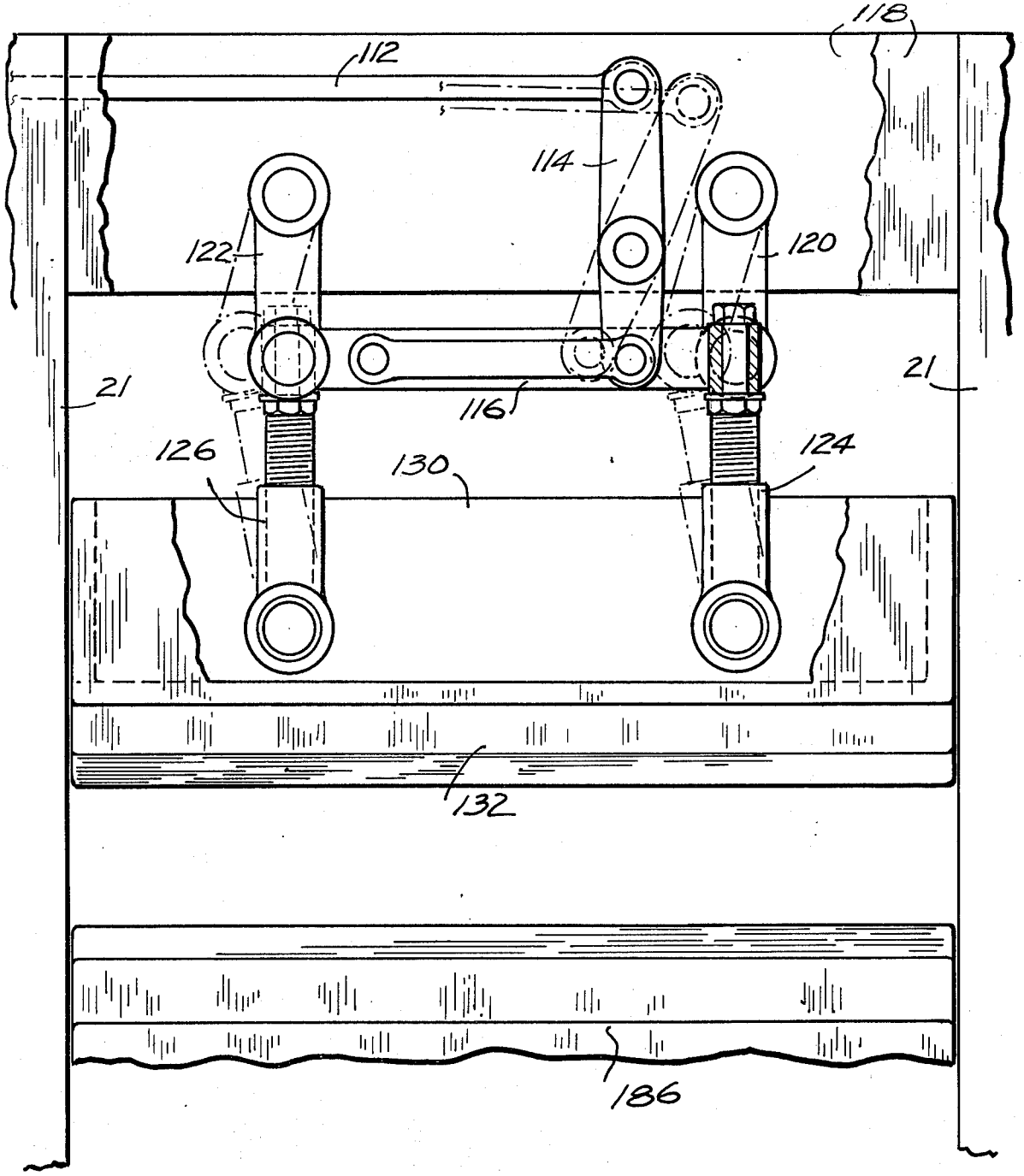
FIG. 3 is a cross sectional view showing the dynamically controlled toggle arrangement for the raising and lowering of the forming element and taken on the line 3—3 of FIG. 1B.

The toggle mechanism for raising and lowering the second stage forming elements of the machine is shown in FIG. 3. In that connection there is provided an actuator rod 112 which is positioned by an SCR circuit in the same manner as that used in the first stage, and is connected to the top of pivot link 114 the end of which is connected to cross arm 116 being pivotally mounted between plates 118 which are supported by the vertical standards 21. Also carried by the plates 118 are toggle links 120 and 122 which are actuated by the cross arm 116 and the pivot link 114 when the rod 112 is moved by a linear actuator, (not shown). The lower portion of the toggle links 120 and 122 are threaded and sleeves 124 and 126, respectively, are adjustably carried thereon. The sleeves 124 and 126 support the forming element mechanism 128 of the second stage of the machine.

Figure 6:
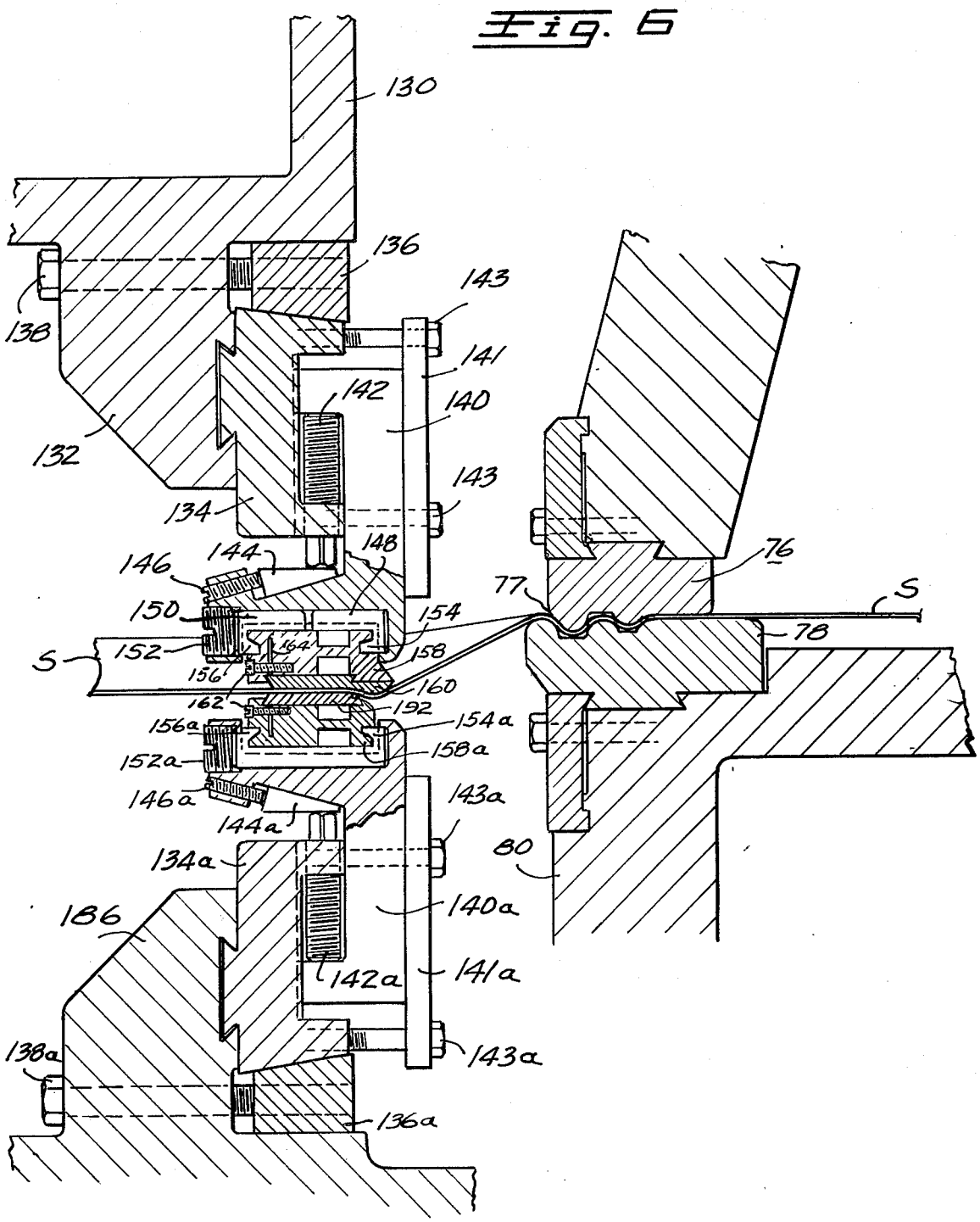
FIG. 6 is a longitudinal section of the first, second and third stages and taken on the line 6—6 of FIG. 2.
Figure 7:
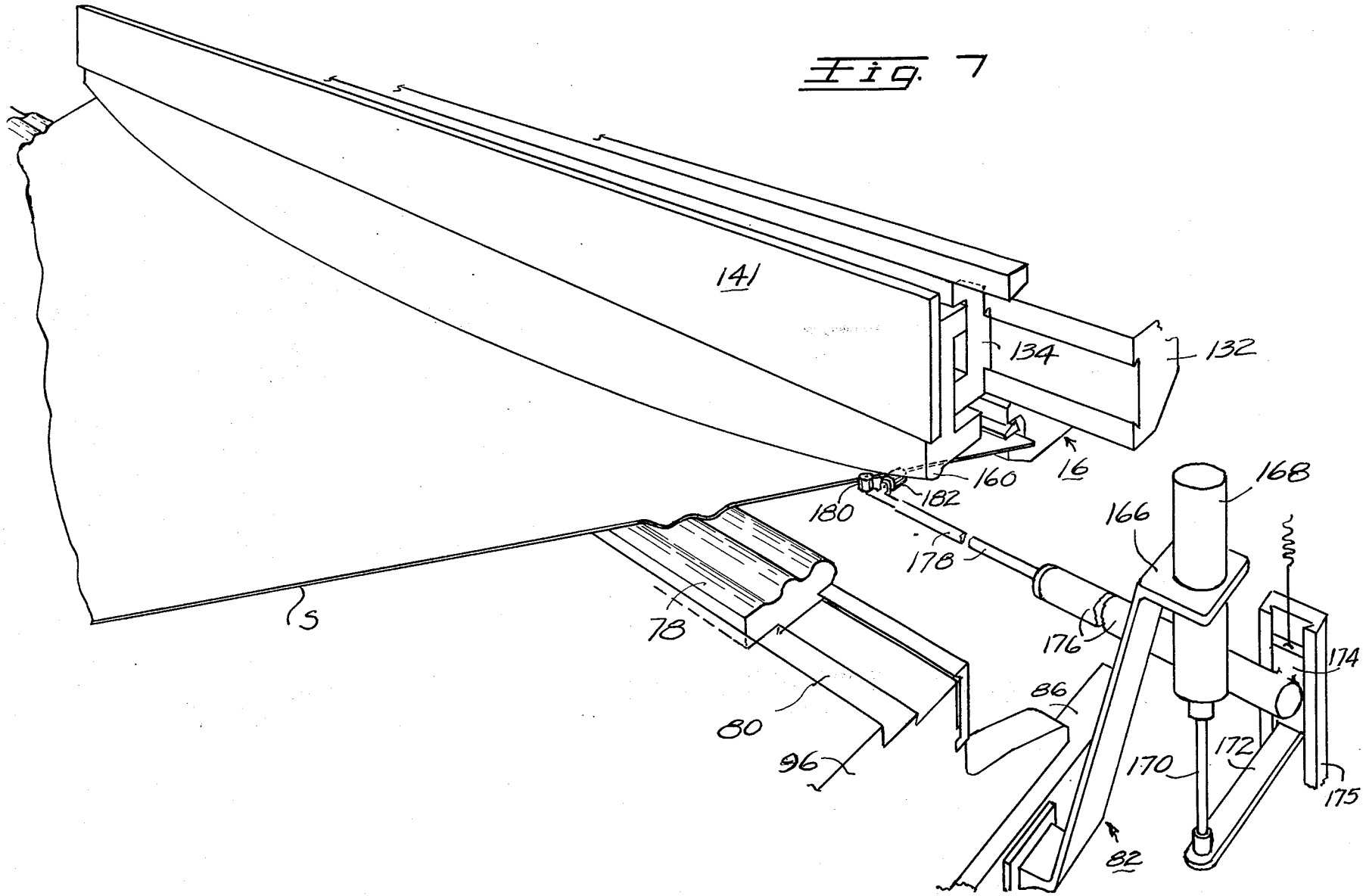
FIG. 7 is a perspective view showing the probe for maintaining a constant differential height relationship between the first and second stages.

As shown in FIG. 6 the sleeves 124 and 126 of the toggle mechanism carry a U-shaped bracket 130 which has a lower extension member 132 with a dovetail groove formed therein. Inserted in the dovetail groove is holding plate 134 which is locked in position by lock bar 136 wedged against the plate 134 by screws 138. Transversely spaced ajustable C-clamps 140 are retained in place against the holding plate 134 by means of retaining plate 141 and srews 143. The C-clamps are held by the plate 134 being vertically adjustably positioned therein by screw 142 and locked in its adjusted position by wedges 144 which are tightened by screws 146. In the bottom of each C-clamp there are mounted split swivel rods 148 and 150 held therein by screw plugs 152. Split swivel rods 148 and 150 have inwardly extending fingers 154 and 156 to hold a flexible strip 158. The flexible strip 158 is dovetailed in its bottom surface in order to receive the forming strip 160 which serves as the second stage curvature forming strip. The forming strip 160, fabricated of hardened steel, is retained in locked position with respect to the flexible strip 158 by means of locking screw 162 and slot 164. The advantage of this construction in permitting easy replacement of the forming strip 160 can be appreciated.

Supported by the wall 86 of the carriage 82 by means of bracket 166 is the transducer 168 having tracer element 170. The tracer element 170 coacts with an extension 172 of slide 174 supported in vertical way 176. Also mounted on the slide 174 is a follower assembly 175 having a spring loaded sensor arm 178 which has mounted thereon a first roller 180 adapted to bear against the edge of metal sheet S as it approaches the second stage forming elements. A second roller 182 mounted on the sensor arm 178 is disposed under the curved surface of the forming elements in the second stage causing the slide 174 to follow the curvature of the forming elements as the roller 180 remains in contact with the edge of the sheet as where the edge of the sheet tapers inwardly. As the roller 182 descends for a tapering sheet the tracer element 170 will be caused to move from its null position by the change in position of extension 172 to generate a current to drive motor 184, see FIG. 1B, to drive the linear actuators 88 in order to lower the carriage 82 and the first stage of the machine and the sheet blank support table 12. The reason for this transducer action is to maintain a constant and proper vertical distance instantaneously between the first stage element 78 and the second stage element 160 as the width of the sheet S changes.

The third stage structure 186 is mounted on roller bearings supported by platform 188 and is moveable longitudinally by linear actuator 190 controlled by the cable 48. The motor (not shown) for the linear actuator 190 is energized by means of the transducer 40 the tracer element 44 of which follows the linear cam 37. Forming element 192 of the third stage is replaceable in the manner of the forming elements 160 for the second stage of the machine and the supporting structure therefore is identical to that in the second stage, the corresponding parts in the third stage having the same reference numerals as those in the second stage with the addition of the suffix *a.*

Figure 8:
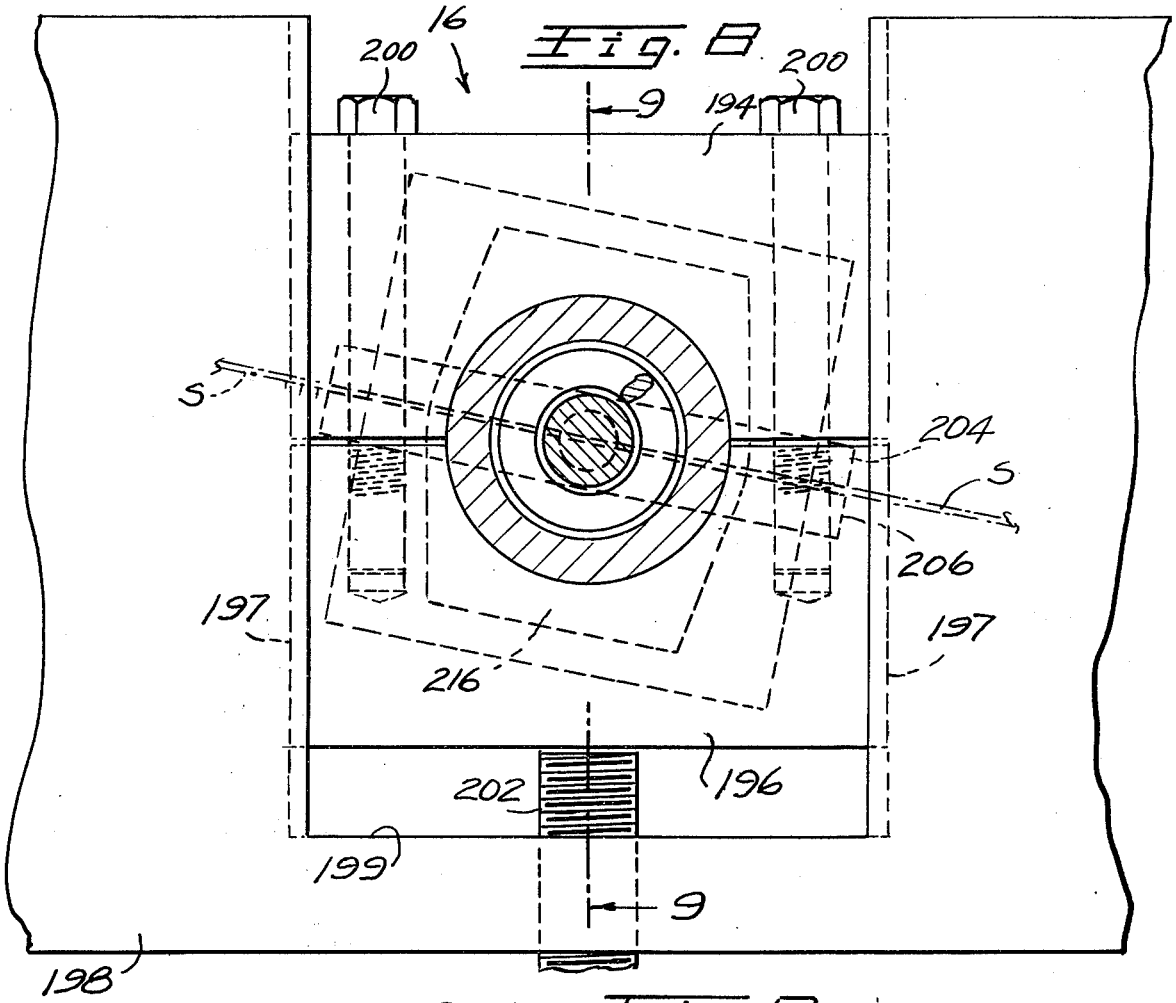
FIG. 8 is a sectional view showing the adjustment means for angularly positioning of the jaws and taken on the line 8—8 of FIG. 1B.
Figure 9:
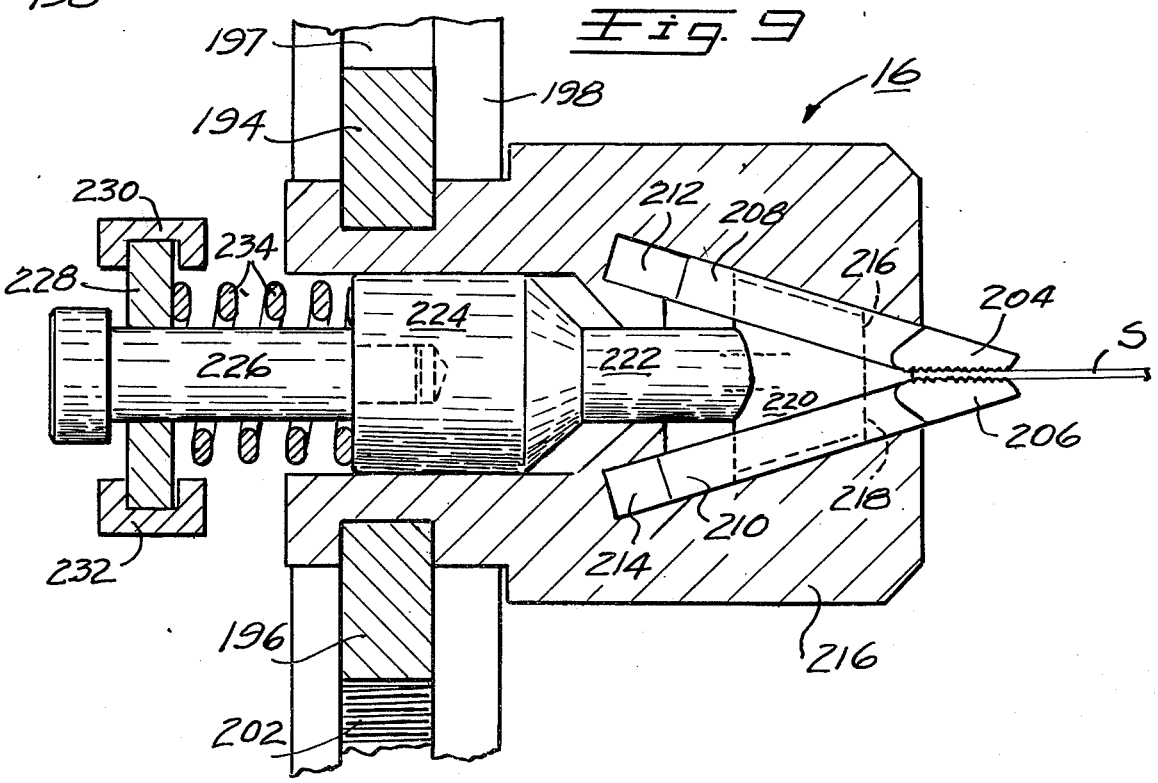
FIG. 9 is a longitudinal section through one of the jaws and taken on the line 9—9 of FIG. 8.

The jaw mechanism 16 is shown in FIG. 8 and FIG. 9. Each jaw mechanism is held in split blocks 194 and 196 which are supported in grooves 197 formed in slots 199 within cross beam support 198 carried by the carriage 18 once the angle of the jaw mechanism is set to grip the curved, leading edge of the metal sheet S. Screws 200 tighten the two split blocks 194 and 196 to lock the position of the jaws in their desired angular orientation.

The jaw mechanism 16 is vertically adjusted within the slots 199 by means of screw 202. Jaw gripping elements 204 and 206 have extension members 208 and 210, respectively, which are contained within rearwardly converging passageways 212 and 214 formed in housing 216 for the jaw mechanism. Apertures 216 and 218 formed in the extension members 208 and 210 receive the cross member 220 of a T-shaped plunger 222 having an enlarged end portion 224. Screwed into the enlarged portion 224 of the plunger is shouldered screw 226. Slidably mounted on the forward end of the screw is a washer 228. Pusher bars 230 and 232 engage the washer 228 and compression spring 234 extending between the washer and the enlarged plunger portion 224 are used to urge the jaw extension elements together in their converging passageways so as to cause the jaw gripping elements 204 and 206 into gripping engagement with the metal sheet S. It may be noted that the greater the restraint exercised on the metal sheet S by the first stage of the machine, the tighter will be the gripping action of the jaws on the sheet due to the convergence of their extension members in passageways 212 and 214 as seen in FIG. 9.

It will be understood that the details of the construction as shown in the drawings and above particularly described, are merely illustrative of the invention and that modifications may be made therein by those skilled in the art within the scope of the invention as defined in the following claims.

What is claimed is:

1. A forming by drawing machine comprising first, second and third stages of forming elements, means for drawing a metal sheet through the three stages, said first stage having opposing and intermeshing elements adapted to apply a restraining force to a sheet being drawn through said forming machine, means dependent on the changing transverse physical dimensions or lateral contour of said sheet during its travel being provided for dynamically and electronically raising and lowering together the opposing elements of said first stage, additional means independent of the physical dimensions and travel of said sheet for dynamically and electronically controlling the horizontal positioning of said elements in a predetermined manner.

2. A forming by drawing machine as defined in claim 1 wherein said first mentioned means are disposed between said first and second stages and include a spring loaded sensor arm and roller for making edge contact with said sheet being thereby adapted to trace said edge, the raising and lowering of said first stage being responsive to the lateral position of said spring loaded sensor.

3. A forming by drawing machine as defined in claim 2 wherein a second roller is mounted on said sensor arm being disposed under and in contact with said second stage forming elements for maintaining said first roller in edge contact with said sheet.

4. A forming by drawing machine as defined in claim 3 wherein said additional means include a ribbon cam surface, a transducer having a tracer element engaging said surface and a motor and actuator controlled by said transducer.

5. A forming by drawing machine as defined in claim 4 wherein means are provided for raising and lowering the upper of said elements of the first stage relative to the lower elements thereof and electronic means are provided for delaying the lowering of said upper elements at the start of machine operation and for causing said upper elements to rise prior to the end of travel of said sheet through the machine whereby distortion of the sheet at the two ends of the sheet due to the intermeshing of the first stage upper and lower elements is eliminated.

6. A forming by drawing machine as defined in claim 5 wherein said opposing elements are horizontally displaceable and there are provided dynamic means for effecting such displacement in a predetermined manner during machine operation.

* * * * *